US005634227A

United States Patent [19]

Lim

[11] Patent Number: 5,634,227

[45] Date of Patent: Jun. 3, 1997

[54] WASHING-TIME COMPENSATING METHOD OF A WASHING MACHINE

[75] Inventor: Seung-Ho Lim, Incheon, Rep. of Korea

[73] Assignee: Daewoo Electronics Co., Ltd., Seoul, Rep. of Korea

[21] Appl. No.: 582,892

[22] Filed: Jan. 4, 1996

[30] Foreign Application Priority Data

Feb. 16, 1995 [KR] Rep. of Korea ..... 1995 2921

[51] Int. Cl.[6] ..... D06F 33/02

[52] U.S. Cl. ..... 8/158; 68/12.05; 68/207

[58] Field of Search ..... 8/158; 68/12.05, 68/12.21, 207

[56] References Cited

U.S. PATENT DOCUMENTS 4,303,406 12/1981 Ross ..... 8/158
4,428,088 1/1984 Getz et al. ..... 8/158
4,697,293 10/1987 Knoop ..... 68/207 X
5,285,545 2/1994 Payne et al. ..... 8/158

*Primary Examiner*—Philip R. Coe
*Attorney, Agent, or Firm*—Beveride, DeGrandi, Weilacher & Young LLP

[57] ABSTRACT

A washing-time compensating method compensates for the washing time of a washing machine according to a water supply time during executing a washing operation. After setting a speculative total washing time required for the washing in accordance with a program internally stored in terms of a washing condition set by a user, a quantity of water supplied up to a predetermined water level within a washtub is sensed to calculate a total water supply time according to the number of supplying the water throughout overall washing procedure. The calculated total water supply time is compared with the speculative total water supply time set in the initial stage to calculate an additional water supply time, so that the washing operation is performed for the washing time obtained by compensating for the total washing time to timely carry out the washing operation within the set washing time.

4 Claims, 2 Drawing Sheets

WASHING-TIME COMPENSATING METHOD OF A WASHING MACHINE

BACKGROUND OF THE INVENTION

1. Field of the Invention

The present invention relates to a method for compensating for a washing time of a washing machine, and more particularly to a washing-time compensating method of a washing machine for sensing a washing time until reaching a predetermined water level while water is supplied to a washtub for performing a washing of the laundry to compensate for overall washing time in accordance with the time sensed.

2. Description of the Prior Art

Generally, full-automatic washing machines cleans the laundry by sequentially executing washing, rinsing, draining and dehydrating strokes under a condition set in accordance with the amount and kind of the laundry input by a user in view of a preset program.

FIG. 1 is a block diagram showing a construction of a conventional washing machine. As shown in FIG. 1, the washing machine includes a key input section 10 for producing a washing command signal by the user's selection, a microcomputer 20 for generating control signals to perform various commands in accordance with the command signal from key input section 10, and a water level sensing section 30 installed within a washtub for detecting a water supply level. In addition, a water supply/drain driving section 40 drains water within the washtub in accordance with the control signals from microcomputer 20 during the water supplying, rinsing or draining strokes. A motor driving section 50 drives a motor for performing the operation such as the water supply, drain, rinsing and dehydrating in accordance with the control signals from microcomputer 20, and a display section 60 informs the user of the current condition.

The cleaning in the conventional washing machine having the above construction is performed such that, when a power is applied to the washing machine, the user selects to provide a desired washing course via key input section 10 and sets the washing course of key input section 10 to carry out the washing process. After putting the laundry into the washtub, a detergent of a proper amount is provided into the washtub. Then, cleaning water is supplied via a water supply opening. At this time, together with the supply of the cleaning water, a rotational blade formed to the bottom side of the washtub to generate a waterstream is rotated at a low speed to consistently stir the laundry and cleaning water prior to the washing stroke. When the cleaning water is continuously poured into the washtub to allow water level sensing section 30 to sense an appropriate filling of the cleaning water in association with the laundry, water level sensing section 30 supplies a sensing signal to microcomputer 20. Then, microcomputer 20 provides a cleaning water supply suspension instruction for stopping the supply of the cleaning water to water supply/drain driving section 40 and motor driving section 50, thereby suspending the water supply. Therefore, the cleaning water suitable for the quantity of the laundry fills in the washtub.

Upon the completion of the supply of the cleaning water, microcomputer 20 instructs a series of operation such as rinsing, draining, water supplying and dehydrating in accordance with a predetermined course.

The above-described series of operation is performed by determining a total washing time in conformity with the internal program of the microcomputer according to the quantity and kind of the laundry. For example, assuming that the microcomputer sets the total washing time to 50 minutes in view of the set condition and the total washing time includes a washing operation once and rinsing stroke twice, the water supply stroke requires three times in total. In addition, if 5 minutes is set for each water supply stroke, 15 minutes is required for the water supply and the remaining 35 minutes are employed for the washing, rinsing and dehydrating strokes.

However, a water pressure in general houses possibly differs per area and relatively differs in accordance with the location of the house even in the same area, and the water pressure status is apt to be temporarily unstable. Therefore, when the water is supplied in accordance with the predetermined time set in advance, the water supply is completed before reaching the preset water supply time or the desired water supply is not conducted in spite of expiring the preset water supply time. In other words, in case that the total water supply time becomes 10 or 20 minutes due to the above-stated reasons, the total washing time is different from the initially set time or the washing of the laundry cannot be completed within the preset washing time. Thus, the washing is completed before/after the estimated washing time, which is inconvenient when regarding the usefulness of the washing machine.

SUMMARY OF THE INVENTION

The present invention is devised to solve the foregoing problems. Accordingly, it is an object of the present invention to provide a washing-time compensating method of a washing machine capable of completing the washing stroke within a preset washing time regardless of a water supply time.

It is another object of the present invention to provide a washing-time compensating method of a washing machine for calculating a water supply time during executing washing and compensating for a washing time set in accordance with the calculated time to complete the washing timely.

To achieve the above object of the present invention, washing-time compensating method of a washing machine is performed by setting a speculative total washing time required for a washing operation in accordance with a washing condition set by a user in view of a program internally stored, and sensing a quantity of water supplied up to a predetermined water level within a washtub. Successively, a water supply time taken up to the predetermined water level in the sensing step is checked, a water supply time up to a water level required for the washing operation is calculated by using the water supply time as a reference, and a total water supply time is produced in accordance with the number of supplying the water throughout the overall washing operation. Then, the actual total water supply time in the producing step is subtracted from the speculative total water supply time in the setting step to calculate an additional water supply time, and the additional water supply time is added to the current total washing time to compensate for the total washing time, so that the washing operation is carried out in accordance with the washing time obtained in the compensating step.

By the above-described method, the washing time is compensated by considering initially-set water supply time and the actual water supply time in accordance with the water supply status. Thus, the washing can be completed by the set washing time punctually.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENT

A washing-time compensating method according to the present invention will be described with reference to accompanying drawings.

Figure 1:
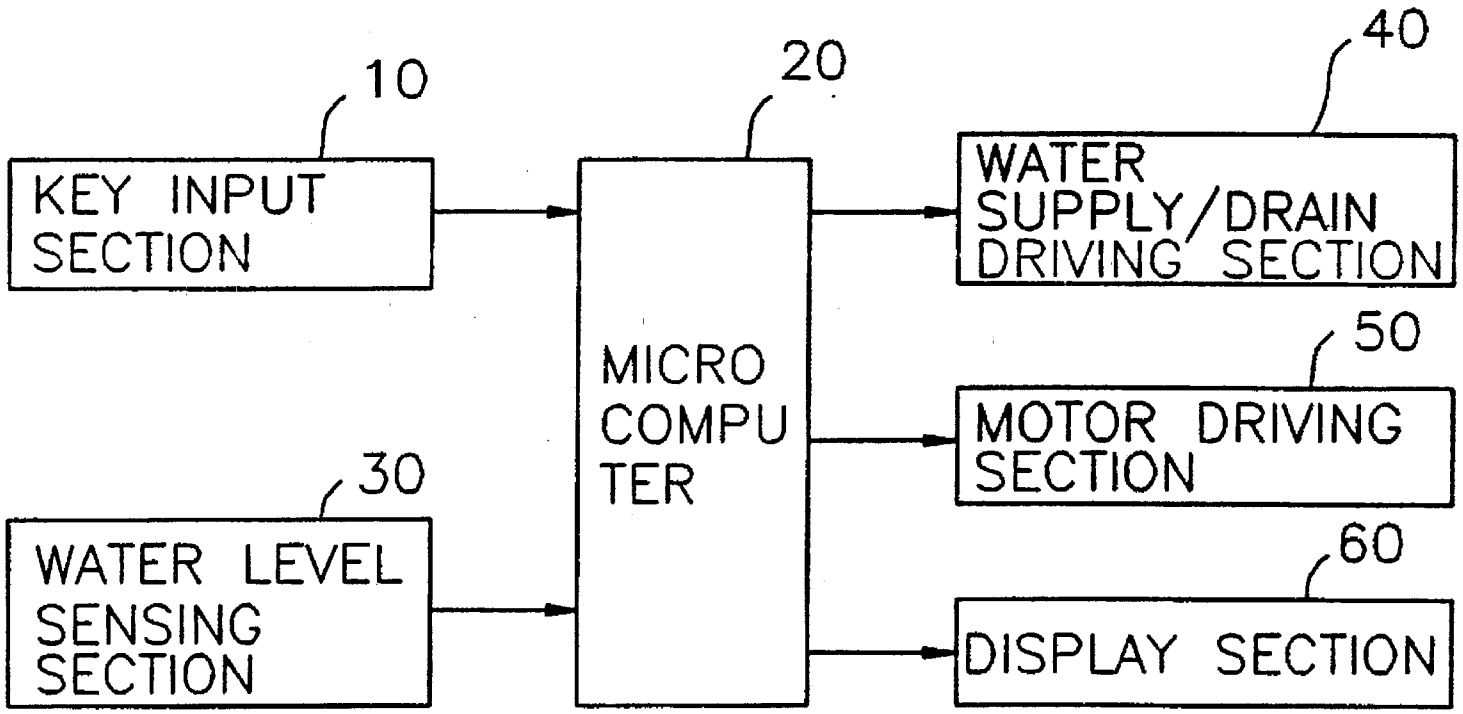
FIG. 1 is a block diagram schematically showing a construction of a conventionally general washing machine.
Figure 2:
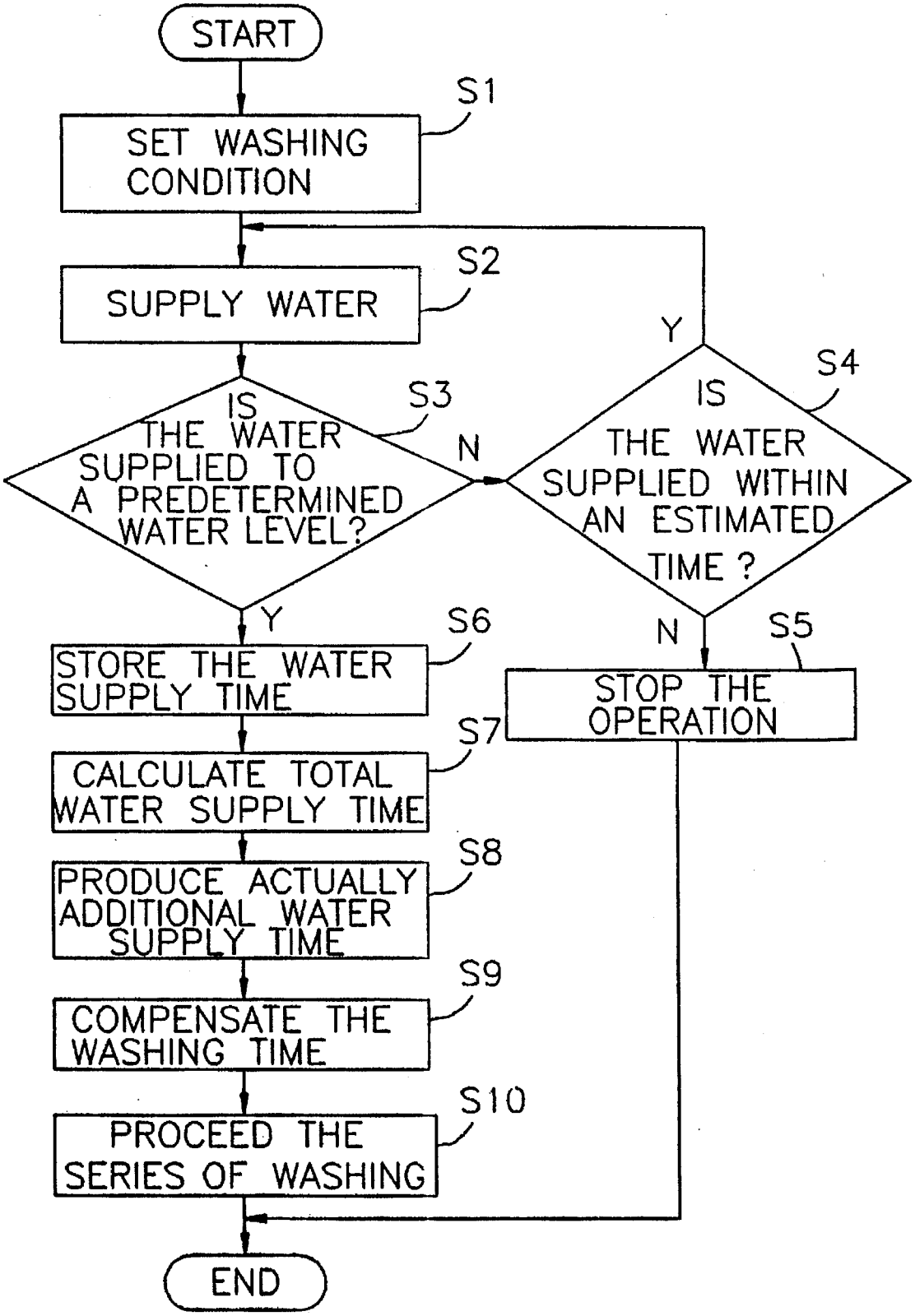
FIG. 2 is a flow chart for illustrating a washing-time compensating method according to the present invention.

FIG. 2 is a flow chart schematically illustrating the method for compensating for the washing time according to the present invention which will be described with reference to the construction of the conventionally general full-automatic washing machine shown in FIG. 1.

In order to wash the laundry, a user set a washing condition via a key input section 10 (S1). The condition set herein includes a kind of the laundry, amount of the laundry to be washed and selection of a washing course. The selection of the washing course is allowing a user to select the starting stage of the washing operation from the initial step, middle step or the final dehydrating step by the user in accordance with the laundry. The washing course set in the present invention is of washing from the initial step.

When several conditions are set by the user as described above, a microcomputer 20 receives signals from key input section 10 to set an executing time per step such as the water supply, washing, rinsing, draining and dehydrating and a total washing time in accordance with the internal program stored therein. The total washing time set as above is displayed on a display section 60 provided to a front panel including key input section 10 in consideration of user's convenience.

After setting the total washing time, microcomputer 20 initiates the water supply (S2). The water supply is originated by the supply of a control signal from microcomputer 20 to a water supply/drain driving section 40. When the water supply is started, microcomputer 20 utilizes a water level sensor of a water level sensing section 30 installed within a washtub to check whether the water supply is carried out up to a predetermined water level (S3). The water level capable of being set at this time is classified into the highest, middle, low, small and minimum water levels, in which the time required to the minimum water level is checked by a built-in timer therein.

At this time, an estimated time required for supplying the minimum water level is set to check whether the water supply is performed up to the highest water level within the estimated time or not (S4). Thus, if the water supply is not completed within the estimated time, a step for generating a water supply error from microcomputer 20 may be further included to stop the operation of the washing machine (S5).

When the water supply time for reaching the minimum water level is checked, microcomputer 20 stores the checked time in a memory (S6). After storing the time in the memory, the stored water supply time is utilized to calculate time required to reach the water level intended.

The aforementioned procedure will be described by taking an example. It is assumed that a general washing time is set to approximately 53 minutes from the starting to ending of the washing operation when a normal water supply is executed to the highest water level. At this time, if a washing is performed once and rinsing is twice in the whole washing course, the total water supply time is obtained by multiplying the water supply time by thrice. Providing that the water supply time is 4 minutes, the total water supply time is set to 12 minutes and the time for cleaning the laundry is to 41 minutes.

Under the state of setting as above, assuming that the time required for supplying the water to the minimum water level which is the predetermined set water level is to be for example 2 minutes owing to the change of the water supply status, microcomputer 20 calculates the total water supply time based on the sensed time (S7). Because the water supply level is classified into five steps, the water supply time for the first washing requires 10 minutes. Consequently, the total water supply time is calculated as 30 minutes since the water is supplied three times throughout the whole washing procedure.

After calculating the total water supply time, microcomputer 20 compares the calculated total water supply time with the speculative total water supply time set in the foregoing step to produce an actually additional water supply time (S8). More specifically, since the speculative total water supply time is 12 minutes and the actual water supply time is 30 minutes, a difference of 18 minutes appears as the additional water supply time.

By checking the difference between the speculative total water supply time set in the initial stage and the calculated actual total water supply time as described above or not, a washing time compensating step is performed (S9).

The compensation of the washing time is carried out by adding the additional water supply time to the current total washing time. That is, the current total washing time is 51 minutes obtained such that 2 minutes which is the water supply time until reaching the minimum water level for compensating for the washing time is subtracted from 53 minutes which is the total washing time set in the initial stage. Then, the additional water supply time of 18 minutes is added to the current total washing time of 51, thereby compensating for the washing time to 69 minutes. Once the compensation with respect to the washing time is internally attained in this manner, the actual total washing time of 69 minutes after effecting the compensation is displayed on a display panel as the time required for the washing operation on behalf of the user's convenience in place of the total washing time initially set to be subtracted in the course of the washing operation.

While the incrementing of the total washing time varied due to the increase of the water supply time as much as the increased time to thereby compensate for the washing time is given as an example in the above description, the compensation of the washing time by subtracting the water supply time shortened from the total washing time when the water supply is finished faster than the estimated time can be identically executed in conformity with the above-described procedure.

When a driving signal is provided into microcomputer 20 after compensating for the washing time as identified in the above description, microcomputer 20 controls water supply/drain driving section 40 in accordance with the predetermined program set in advance to supply the water while sensing the set water level by means of water level sensing section 30. Microcomputer 20 subtracts the water supply time from the total water supply time, and performs the washing operation while subtracting the time required per step from the total washing time by controlling a motor driving section 50 to proceed the series of washing stroke (S10).

In the present invention as described above, the water supply time for reaching the predetermined water level is checked during executing the washing operation, and the water supply time up to the water level intended to wash the laundry is calculated by using the time checked as above. Then, in accordance with the calculated time, the difference from the preset water supply time is added to the washing time to compensate for the total washing time. Therefore, the washing operation is carried out in accordance with the compensated total washing time regardless of the variable water supply status, so that the washing operation is timely executed within the set washing time.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A washing-time compensating method of a washing machine comprising the steps of:

setting a speculative total washing time required for a washing operation in accordance with a washing condition set by a user in view of a program internally stored;

sensing a quantity of water supplied up to a predetermined water level within a washtub;

checking a water supply time taken up to said predetermined water level in said sensing step, calculating a water supply time up to a water level required for the washing operation by using said water supply time as a reference, and producing a total water supply time in accordance with the number of supplying the water throughout the overall washing operation;

executing the subtraction of the actual total water supply time in said producing step and speculative total water supply time in said setting step to calculate an additional water supply time; and adding said additional water supply time to the current total washing time to compensate for said total washing time, whereby said washing operation is carried out in accordance with the washing time obtained in said compensating step.

2. A washing-time compensating method of a washing machine as claimed in claim 1, wherein said producing step further comprising a step of suspending the operation of said washing machine when said water supply time to reach said predetermined water level is not completed within a set time range.

3. A washing-time compensating method of a washing machine as claimed in claim 1, wherein said sensing step is for sensing the quantity of the supplied water at a sensible minimum water level within said washtub.

4. A washing-time compensating method of a washing machine as claimed in claim 1, further comprising the step of subtracting the washing time required for executing per step from said total washing time obtained in said compensating step, and displaying the result.

* * * * *